US007908971B2

(12) United States Patent
Gustafsson et al.

(10) Patent No.: US 7,908,971 B2
(45) Date of Patent: Mar. 22, 2011

(54) PROPELLANT CHARGE FOR RECOILLESS GUN

(75) Inventors: Pär Gustafsson, Linköping (SE); Henrik Irdell, Västeras (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 12/245,153

(22) Filed: Oct. 3, 2008

(65) Prior Publication Data

US 2009/0151586 A1 Jun. 18, 2009

(30) Foreign Application Priority Data

Oct. 3, 2007 (EP) ..... 07117803

(51) Int. Cl.
*F42B 5/05* (2006.01)

(52) U.S. Cl. ..... 102/437; 102/283; 89/1.7

(58) Field of Classification Search ..... 102/283, 102/290, 291, 292, 437; 89/1.7, 1.701, 1.703, 89/1.706

See application file for complete search history.

(56) References Cited

U.S. PATENT DOCUMENTS

| | | | | |
|---|---|---|---|---|
| 3,967,558 | A | 7/1976 | Brody et al. | |
| 4,676,136 | A * | 6/1987 | Kalin | 89/1.701 |
| 5,162,604 | A | 11/1992 | Wilson | |
| 5,357,841 | A * | 10/1994 | Clark et al. | 89/1.701 |
| 6,971,299 | B2 | 12/2005 | Franzen et al. | |
| 7,350,449 | B2 * | 4/2008 | Franzen et al. | 89/1.701 |
| 2005/0235816 | A1 * | 10/2005 | Franzen et al. | 89/1.701 |

FOREIGN PATENT DOCUMENTS

| | | |
|---|---|---|
| CH | 651131 A5 | 8/1985 |
| EP | 0499244 A | 8/1992 |

OTHER PUBLICATIONS

European Search Report—Mar. 20, 2006.

* cited by examiner

*Primary Examiner* — Benjamin P Lee

(74) *Attorney, Agent, or Firm* — Venable LLP; Eric J. Franklin

(57) ABSTRACT

A propellant charge for a recoilless gun, in particular a propellant charge for a round of a reloadable support weapon. The propellant charge is cylindrically shaped and adapted for loading into a charge chamber formed between an inner casing and an outer casing of the round.

3 Claims, 4 Drawing Sheets

PROPELLANT CHARGE FOR RECOILLESS GUN

CROSS-REFERENCE TO RELATED APPLICATIONS

This application claims priority to European patent application 07117803.2 filed 3 Oct. 2007.

BACKGROUND OF THE INVENTION

1. Technical Field of the Invention

The present invention relates to a propellant charge for a recoilless gun. More particularly, the invention relates to a propellant charge which is mainly adapted for a round of a reloadable support weapon, as the M3 Carl Gustaf, in order to prevent the charge from breaking into peaces and powder grains from moving around in the combustion chamber during transport, handling and firing of the rounds.

2. Description of Related Art

In conventional rounds of the initially mentioned kind the propellant charge might consist of powder grains or strips which are loosely applied with no support in the combustion chamber of the casing of the round.

Hence, a propellant charge comprising loosely applied powder grains or strips with no support might be broken, divided into pieces, dispersed and/or moved around in the combustion system of the round during transport and handling.

Further, during the combustion powder fragments might be transported between different parts of the combustion system, which makes it uncertain where and when the combustion takes place.

Consequently, the process of combustion would not be predictable and a uniform process of combustion not guaranteed, which might result in residual powder fouling of barrel being thrown out together with the combustion gases.

Hitherto, several attempts have been made to keep the strips in place by means of rubber bands or similar devices. Further, for example the document U.S. Pat. No. 3,967,558 discloses a support structure for supporting perforated strips in a radial cylindrical configuration by support rings. Unfortunately, the charge- and combustion chambers of said round, to which the propellant charge according to the present invention be adapted, is formed as a relatively thin cylindrical slot, which means there is too little space for the use of perforated strips supported in a radial cylindrical configuration by support rings, e.g. as is described in U.S. Pat. No. 3,967,558.

Therefore, so far the results of said attempts have been unsatisfactory and up till now the related technical field lacks a suitable solution to this problem.

SUMMARY OF THE INVENTION

It is an object of the present invention to provide an improved propellant charge solution which does not suffer from the drawbacks in the related art.

For this purpose, a propellant charge according to the present invention, is characterized in that said propellant charge is cylindrically shaped and adapted for loading into a combustion chamber formed between an inner casing and an outer casing of said round.

Further objects, improvements and developments appear from the dependent claims and the description with reference to the accompanying schematic drawings.

DESCRIPTION OF EMBODIMENT OF THE INVENTION

In stead of loose powder grains the charge according to the invention is made in the form of a solid propellant charge, which is stationary arranged in a casing assembly of a round.

Figure 1:
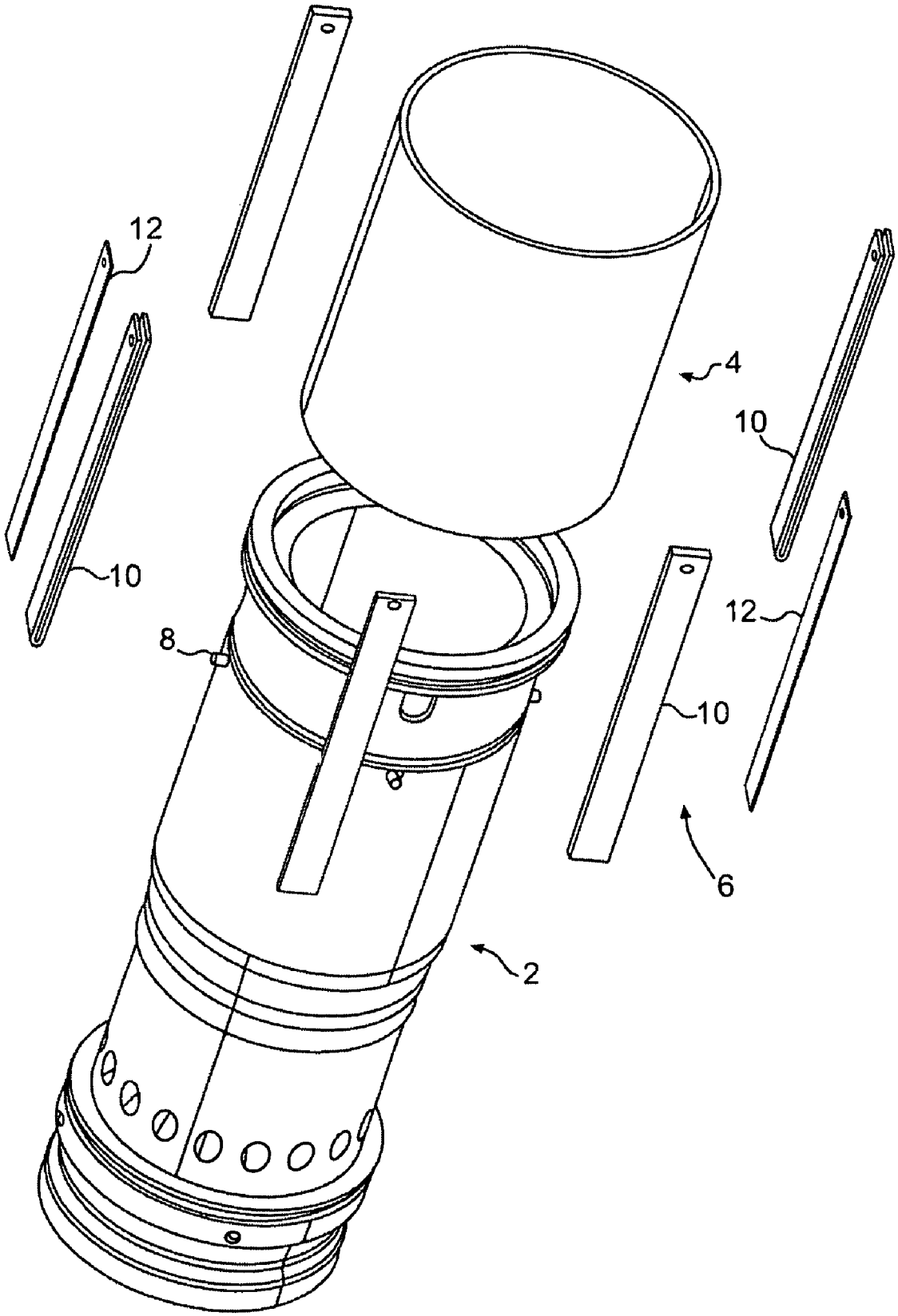
FIG. 1 is an exploded perspective view depicting an example of a propellant charge embodied by a tubular formed powder sheet and elements of its holding fixture as adapted to fit with the inner casing of the casing assembly, the outer casing be excluded.

FIG. 1 is an exploded perspective view depicting an example of an inner casing 2 and a propellant charge 4 embodied by a cylindrical cartridge configured by a tubular formed powder sheet 4 and a holding fixture 6 for said powder sheet as adapted to fit with said inner casing 2 of said assembly. It is desirable the charge be configured from at least one sheet 4 of powder in correspondence with the actual size of the available space or clearance in the assembly. Hereby, said sheet of powder can be pushed into, and simultaneously bent into the desired configuration to fit with, said holding fixture 6. The sheet 4 is hereby arranged to be extended over essentially the entire circumference of the inner casing 2, which means a holding grip can be exerted by the holding fixture in both radial and longitudinal directions of the so configured powder sheet 4, which will be described in more detail in the following.

Therefore, in the present case the charge 4 might be configured according to a first embodiment by just one thickness of powder sheet as a single layer tubular formed powder sheet 4, as disclosed in FIGS. 1, 2 and 4, or a plurality of coaxially arranged layers according to a second embodiment, which will be described in more detail later. For this purpose, in the embodiments first and second fastening elements 8, 10 and spacer elements 12 might be provided, for making up said holding fixture 6, which will also be described in more detail later. The inner casing 2 is of a conventional design used in e.g. a reloadable, recoilless support weapon as the M3 Carl Gustaf, and is therefore not described further here. Said powder sheet 4 can be initiated by an ignition device conventionally used in this kind of weapons. A prior art recoilless weapon of this kind is for example described in U.S. Pat. No. 6,971,299.

Figure 2:
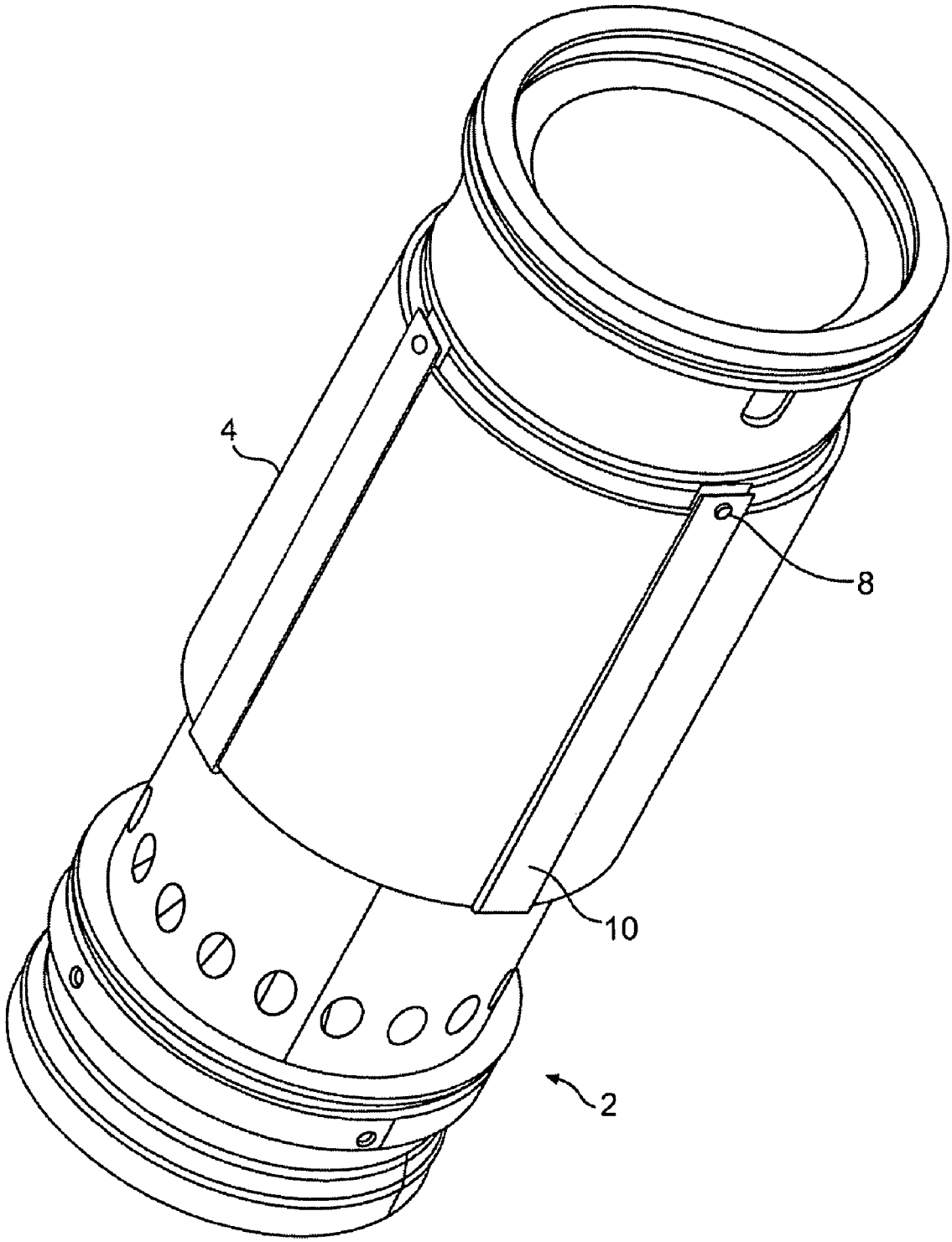
FIG. 2 is a view as FIG. 1 depicting said powder sheet attached to the inner casing by means of the holding fixture.

FIG. 2 is a view similar to FIG. 1 disclosing said first embodiment and depicting said powder sheet 4 attached to the inner casing 2 by means of said first fastening elements 8, here anchor pins 8 and said second fastening elements 10, here braces 10. It appears that the powder sheet 4 is arrested by means of said braces 10, which are bent around the powder sheet 4 and extended over longitudinal pieces of its envelope surface. The anchor pins 8 are extended in through bores of the braces 10 and firmly connected, e.g. riveted or bolted, to the inner casing 2.

Figure 3:
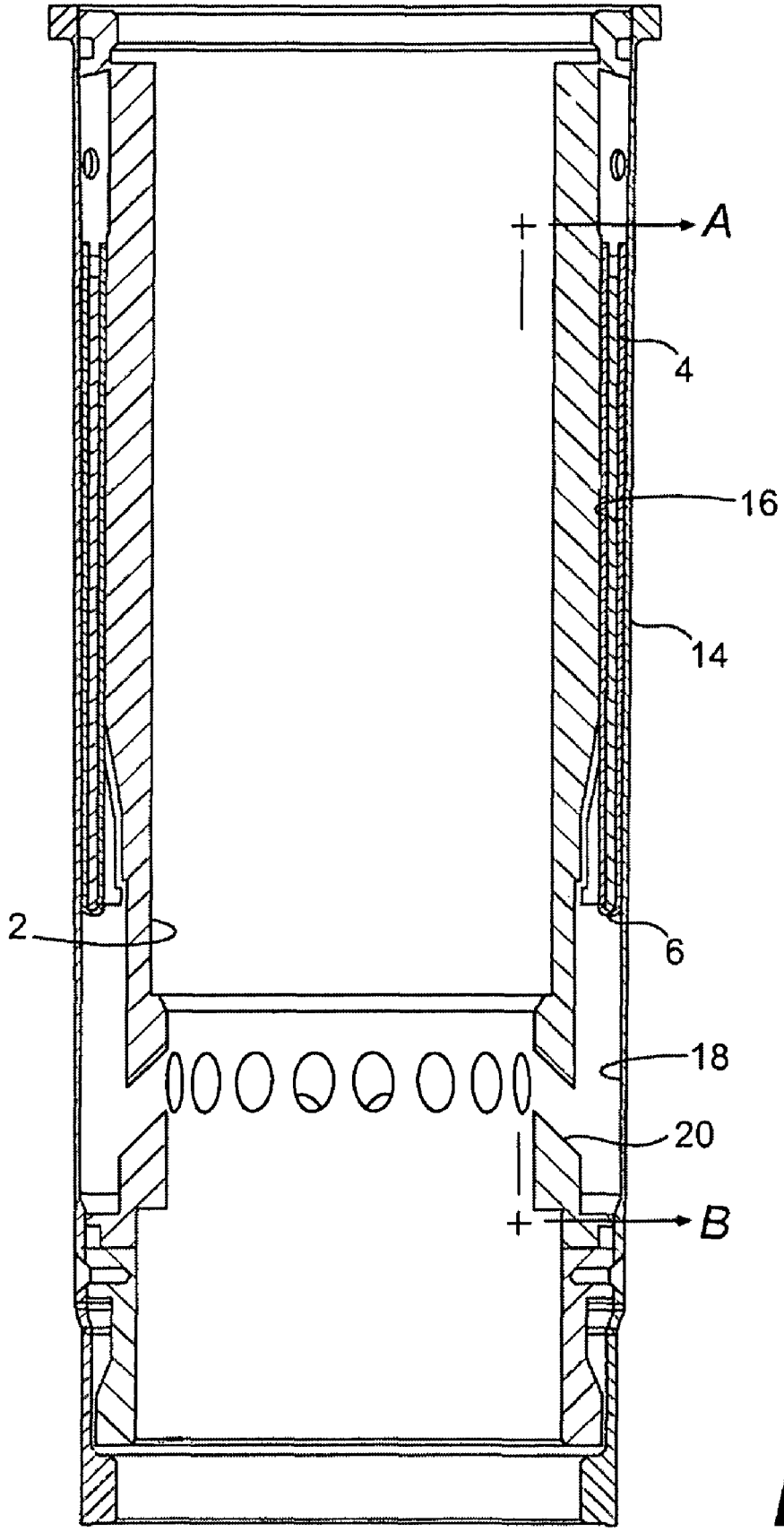
FIG. 3 is a longitudinal section of the casing assembly completed with the outer casing enclosing the powder sheet and sealing off the charge- and combustion chambers.

FIG. 3 is a longitudinal section of the casing assembly, the inner casing 2 completed with an outer casing 14 enclosing the powder sheet 4. Further, it appears that a charge chamber 16 widens into a combustion chamber 18, which both are enclosed and sealed off relative to the inner casing 2 by said outer casing 14. Furthermore, the powder sheet 4 can be seen, located in the charge chamber 16 and in a holding grip of its holding fixture 6. Said combustion chamber 18 is conventionally associated with the inside of the inner casing 2 by means of nozzles 20.

Figure 4:
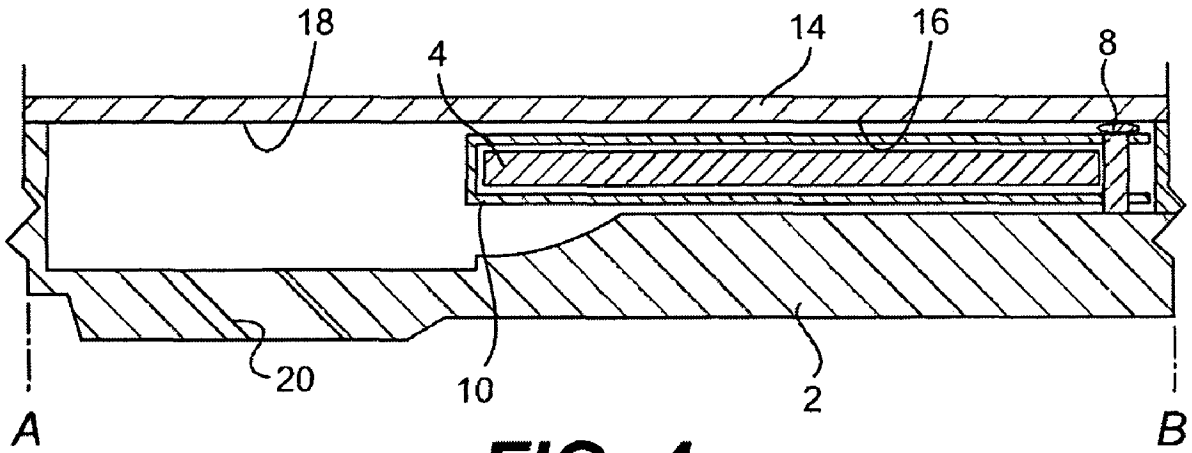
FIG. 4 is an enlarged, non-proportional section cut through lines A-B of the casing assembly in FIG. 3.

FIG. 4 is an enlarged, non-proportional section cut through lines A-B of the casing assembly in FIG. 3. It appears that the tubular formed powder sheet 4, by means of each anchor pin 8 and each brace 10, is arrested in position in the charge chamber 16, formed between the inner casing 2 and the outer casing 14. It is also evident that the charge chamber 16 mergers into the combustion chamber 18, and is associated with the inside of the inner case by said nozzles 20, one of which is disclosed. The powder sheet 4 is shown with a relatively large thickness, however it might be varied appropriately to meet different demands of pressure, within the limits given by the available space in said chambers.

Figure 5:
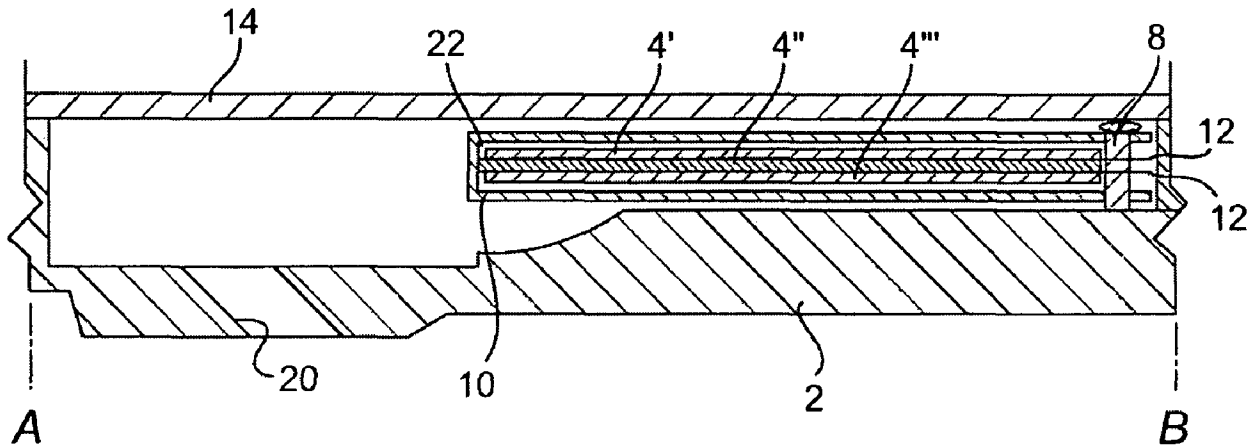
FIG. 5 is a view like FIG. 4 which discloses a development of the propellant charge.

FIG. 5 discloses a view similar to FIG. 4 of a second embodiment of the present invention. In addition to the first and second fastening means 8 (anchor pins) and 10 (braces) respectively, in the second embodiment even the spacer elements 12 are used to make up the holding fixture 6. Accordingly, in said second embodiment a combined propellant charge 22 might be configured by a plurality of coaxially arranged powder sheets 4, each comprising a single layer tubular formed powder sheet and fitting close upon each other.

For this purpose, in this embodiment three powder sheets are combined to make up said charge 22, an outer powder sheet 4', a middle powder sheet 4" and an inner powder sheet 4''' are shown with a relatively narrow thickness. The outer sheet 4''' is spaced from the middle sheet 4" and the middle sheet 4" from the inner sheet 4''' by means of a spacer element 12 each. The spacer elements 12 and each brace 10 are attached to the inner casing 2 by means of the anchor pins 8. It appears that the combined charge 22 is arrested by means of said braces 10, as bent around all of the powder sheets 4', 4" and 4''' and extended over longitudinal pieces of their envelope surfaces. Even in this embodiment, the anchor pins 8 are extended in through bores of the braces 10 and spacer elements 12 and firmly connected, e.g. riveted or bolted, to the inner casing 2.

Hence, by means of the spacer elements 12, which might be of an appropriate thickness to facilitate uniform ignition of the powder tubes by means of a conventional ignition system, it is achievable that less powder residues are let out to the environment.

It is noted, that the combined charge 22 can be adapted by varying the number and thickness of powder sheets 4', 4", 4''' even if they are shown with a relatively small thickness at a number of three. However, even in this embodiment consideration must be done to ensure any adaptation would be appropriate to meet different demands of pressure, within the limits given by the available space in said chambers.

The invention claimed is:

1. A propellant charge for a round of a reloadable support weapon, the propellant charge comprising:

a cylindrically shaped propellant charge comprising at least one tubular sheet arranged in a charge chamber arranged between an inner casing and an outer casing of said round; and a holding fixture configured to attach the propellant charge to the inner casing, wherein the holding fixture is configured to lock a radial position and a longitudinal position of the charge in the charge chamber, and wherein the holding fixture comprises braces extending over a surface of the tubular sheet.

2. The propellant charge according to claim 1, wherein the propellant charge is oriented as an envelope surface essentially in parallel with and extended over essentially an entire circumference of at least the inner casing, wherein the holding fixture extends over the envelope surface.

3. The propellant charge according to claim 1, wherein said propellant charge comprises a cylindrical cartridge from a sheet of powder.

* * * * *